US006323427B1

(12) United States Patent
Rutledge

(10) Patent No.: US 6,323,427 B1
(45) Date of Patent: Nov. 27, 2001

(54) LOW DELAY SKEW MULTI-PAIR CABLE AND METHOD OF MANUFACTURE

(75) Inventor: Spring Rutledge, Sidney, NE (US)

(73) Assignee: Krone, Inc., Engelwood, CO (US)

( * ) Notice: Subject to any disclaimer, the term of this patent is extended or adjusted under 35 U.S.C. 154(b) by 0 days.

(21) Appl. No.: 09/578,982

(22) Filed: May 25, 2000

Related U.S. Application Data

(60) Provisional application No. 60/136,674, filed on May 28, 1999, now abandoned.

(51) Int. Cl.[7] ..... H01B 7/28
(52) U.S. Cl. ..... 174/113 R
(58) Field of Search ..... 174/27, 113 R, 174/128.1

(56) References Cited

U.S. PATENT DOCUMENTS

| | | | | |
|---|---|---|---|---|
| 5,493,071 | | 2/1996 | Newmoyer | 174/113 R |
| 5,619,016 | | 4/1997 | Newmoyer | 174/113 R |
| 5,763,823 | * | 6/1998 | Siekierka et al. | 174/27 |
| 5,767,441 | | 6/1998 | Brorein et al. | 174/27 |
| 5,814,768 | | 9/1998 | Wessels et al. | 174/110 FC |
| 5,834,697 | | 11/1998 | Baker et al. | 174/113 R |
| 6,096,977 | * | 8/2000 | Beggs et al. | 174/113 R |

FOREIGN PATENT DOCUMENTS

WO 97/39499 10/1997 (WO) .

WO 99/00879 1/1999 (WO) .

OTHER PUBLICATIONS

PCT International Search Report for PCT/US00/14443 Filing date of May 25, 2000. U.S. Pat. No. 5,814,768 cited in the International Search Report was submitted in the Information Disclosure Statement filed in this application on Sep. 15, 2000.

* cited by examiner

*Primary Examiner*—Chau N. Nguyen
(74) *Attorney, Agent, or Firm*—Rader, Fishman & Grauer PLLC

(57) ABSTRACT

The invention is directed to a multi-pair cable having an outer jacket and at least two pairs of twisted wire cables having different lay lengths and being disposed within the jacket. The wires of each twisted wire pair have a conductor surrounded by an insulating material, wherein the conductors of the respective twisted wire pairs have different strand twist lengths. The lay lengths of the twisted wire pairs are correlated with the strand twist length of the conductors of the individual twisted wire pairs so that the phase delay of the twisted wire pairs of the cable is matched to within an acceptable range for data transmission. Conversely, where the lay lengths of the twisted wire pairs is specified, the strand twist lengths of the respective conductors of the individual twisted wire pairs can be correlated with the lay lengths of the twisted wire pairs so that the phase delay of the twisted wire pairs of the cable is brought to within an acceptable range for the intended application.

19 Claims, 2 Drawing Sheets

LOW DELAY SKEW MULTI-PAIR CABLE AND METHOD OF MANUFACTURE

This application claims priority from U.S. Provisional Application Ser. No. 60/136,674 entitled "Low Delay Skew Multi-Pair Cable And Method of Manufacture" filed on May 28, 1999 now abandoned. This application is also related to U.S. application Ser. No. 09/322,857 entitled "Optimizing LAN Cable Performance" filed on May 28, 1999 now U.S. Pat. No. 6,153,826; U.S. Provisional Application Ser. No. 60/137,132 entitled "Tuned Patch Cable" and filed on May 28, 1999 now abandoned; and U.S. application Ser. No 09/578,585 entitled "Tuned Patch Cable" filed on May 25, 2000, the disclosures of which are all incorporated herein by reference.

FIELD OF THE INVENTION

The present invention relates to a cable made of twisted wire pairs, and more particularly to a cable made of twisted wire pairs that is suitable for use in high-speed data communication applications.

BACKGROUND OF THE INVENTION

One method of transmitting data and other signals is by using twisted wire pair cables. A twisted wire pair cable includes at least one pair of insulated conductors twisted about one another to form a two conductor pair. In practice, most network applications use cables with both solid and stranded conductors. A number of methods known in the art may be employed to arrange and configure the twisted wire pairs into various high-performance transmission cable arrangements. Once the twisted pairs are configured into the desired "core," a plastic jacket is typically extruded over them to maintain their configuration and to function as a protective layer. When more than one twisted pair group is bundled together, the combination is referred to as a multi-pair cable.

In cabling arrangements where the conductors within the wires of the twisted wire pairs are stranded, two different, but interactive sets of twists can be present in the cable configuration. First, there is the twist of the wires that make up the twisted wire pair. Second, within each individual wire of the twisted wire pair, there is the twist of the wire strands that form the conductor. Taken in combination, both sets of twists have an interrelated effect on the data signal being transmitted through the twisted wire pairs.

With multi-pair cables, the signals generated at one end of the cable should ideally arrive at the same time at the opposite end even if they travel along different twisted pair wires. Measured in nanoseconds, the timing difference in signal transmissions between the twisted wire pairs within a cable in response to a generated signal is commonly referred to as "delay skew." Problems arise when the delay skew of the signal transmitted by one twisted wire pair and another is too large and the device receiving the signal is not able to properly reassemble the signal. Such a delay skew results in transmission errors or lost data.

Moreover, as the throughput of data is increased in high-speed data communication applications, delay skew problems can become increasingly magnified. Even the delay in properly reassembling a transmitted signal because of signal skew will significantly and adversely affect signal throughput. Thus, as more complex systems with needs for increased data transmission rates are deployed in networks, a need for improved data transmission has developed. Such complex, higher-speed systems require multi-pair cables with stronger signals, and minimized delay skew.

A number of factors can contribute to the timing differences in signal propagation or skew along different twisted wire pairs in a data transmission cable, each of which may have different lay lengths. Such factors include: the amount or degree of twist or "lay length" of each cable; the geometric configurations of the twisted wire pairs and the cable; the chemical and physical properties of the materials used; and the amount or degree of twist or "lay length" in the wire strands that form the individual conductors of the twisted wire pairs. To better distinguish the "lay length" of the twisted wire pairs from that of the wire strands of the conductors, the lay length of the wire strands will hereinafter be referred to as the "strand twist length."

When twisted wire pair cable s are used in connection with high-speed data communication applications, controlling the various factors that affect signal propagation becomes increasingly important. Thus, there is a need for a twisted wire pair cable that addresses the limitations of the prior art to effectively control and minimize delay skew within multi-pair cables.

SUMMARY OF THE INVENTION

The present invention recognizes that a number of factors contribute to differences in the signal propagation along different twisted wire pairs of a multi-pair cable. For instance, when other factors are the same, a signal from a twisted pair with a shorter twist length or lay length can potentially arrive much later than the signal sent through a twisted pair with a longer twist length or lay length. This is primarily due to the fact that an increased length of wire is needed to provide a shorter lay length, or, in other words, more wire is needed to provide a shorter, or "tighter," twist length over a given length of cable. Likewise, the same principle holds true for the twisted wire strands that form the conductor of a stranded conductor.

Standard test methods using commercially available instruments can determine the signal propagation characteristics of a twisted wire pair. One example of such an instrument is a network analyzer, which can determine the difference in phase between the signals of twisted wire pairs. Phase delay is a measurement of the amount of time that a simple sinusoidal signal is delayed when propagating through the length of a twisted wire pair. The delay skew or "skew" is the difference in the phase delay value of two twisted wire pairs. In multi-pair cables having more than two twisted wire pairs, the skew value is represented by the maximum difference in phase delay between any two twisted wire pairs.

To address the problem of delay skew, the present invention correlates several important factors that affect the transmission throughput of the twisted pairs to effectively minimize delay skew and improve the timing between the pairs of the cable. In particular, the present invention focuses on designing and constructing low skew multi-pair cables wherein the twisted wire pairs have different lay lengths and/or strand twist lengths.

In accordance with the teachings of the present invention, the physical properties of the twisted wire pairs affecting signal propagation in a multi-pair cable are taken into account and a multi-pair cable suitable for high-speed data transmission is provided in which the lay lengths of the twisted wire pairs and strand twist lengths of the wire conductors within the twisted wire pairs are correlated and appropriately matched to reduce the associated amount of delay skew. Therefore, a multi-pair cable having features of the present invention includes an outer jacket and at least two pairs of twisted wire cables having different lay lengths and being encased within the jacket. The wires of each twisted wire pair have a conductor surrounded by an insulating material, wherein the conductors of the respective twisted wire pairs have different strand twist lengths. The lay lengths of the twisted wire pairs are correlated with the strand twist length of the conductors of the individual twisted wire pairs so that the phase delay of the twisted wire pairs of the cable is matched to within an acceptable range for data transmission. Conversely, where the lay lengths of the twisted wire pairs is predetermined, the strand twist lengths of the respective conductors of the individual twisted wire pairs can be correlated with the lay lengths of the twisted wire pairs so that the phase delay of the twisted wire pairs of the cable is brought to within an acceptable range for the intended application.

By way of example, when all other factors are approximately the same, a wire with a conductor comprised of wire strands which has a comparably short strand twist length relative to the strand twist length of the other twisted pairs will be included in a twisted pair which has a comparably long lay length. Conversely, a wire with a stranded conductor which has a comparatively long strand twist length will be included in a twisted pair which has a comparatively short lay length. The amount of delay skew is significantly reduced by utilizing longer strand twist length with the tightly twisted pair and a shorter twisted strand twist length with the longer twisted pair because the signal travel path length, measured as "impedance" (or alternatively, as "capacitance") is nearly equal between pairs. By applying this method, signals generated at one end of the cable should ideally arrive at the same time at the opposite end even if they travel along different twisted wire pairs.

Moreover, multi-pair cables constructed in accordance with this invention can be engineered to meet the stringent specifications of high-speed data transmission, such as Category 5 cables, and also to meet the stringent fire and smoke requirements necessary for certain applications.

BRIEF DESCRIPTION OF THE DRAWINGS

A number of features and advantages of the present invention will become apparent from the detailed description of the invention that follows and from the accompanying drawings, wherein.

DETAILED DESCRIPTION OF PREFERRED EMBODIMENTS

Figure 1:
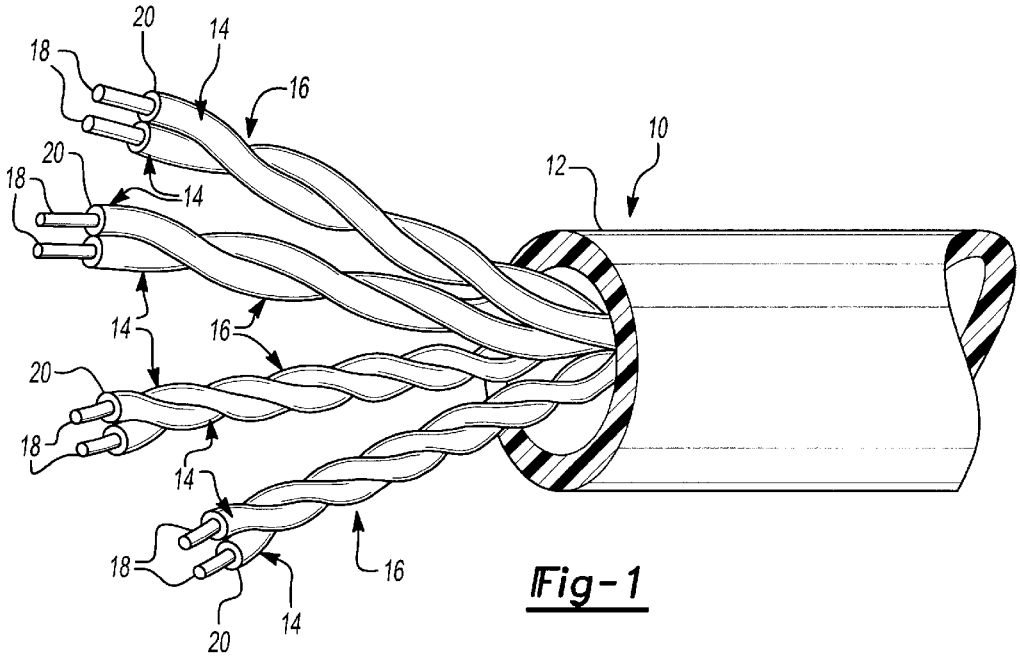
FIG. 1 is a perspective view of a portion of a multi-pair cable according to one embodiment of this invention, wherein the cable has four twisted wire pairs.

FIG. 1 shows a portion of a data transmission cable 10 having four pairs of twisted wires 14 disposed within an outer jacket 12. The individual wires 14 of a twisted wire pair 16 are each comprised of a conductor 18 surrounded by an insulating material 20. Examples of some acceptable conductive materials that can be used to form the conductors 18 include copper, aluminum, copper-clad steel and plated copper. It has been found that copper is the optimal conductor material.

Each of the twisted wire pairs 16 may also be individually or collectively wrapped in a foil shield or other type of conventional shield for additional protection, but FIG. 1 shows the cable 10 without such a shield. Typically, four sets of twisted wire pairs 16 are found and used in Local Area Networks (LAN). However, a cable 10 may include any plural number of twisted wire pairs.

Outer jacket 12 is formed over the twisted wire pairs 16 and an optional foil shield (not illustrated), by any conventional process. Examples of some of the more common processes that may be used to form the outer jacket 12 include injection molding and extrusion molding. Preferably, the jacket 12 is comprised of a plastic material, such as fluoropolymers, polyvinyl chloride (PVC), or a PVC equivalent that is suitable for cable communication use.

The insulating material 20 protects both the conductor 18 and the signal being transmitted therein. The composition of the insulating material 20 is important because the dielectric constant of the chosen insulating material 20 will affect the velocity at which a signal will propagate through a conductor 18. The insulating material 20 may be an extruded polymer layer, which may be formed as a solid or foam. Any of the conventional polymers used in wire and cable manufacturing may be employed, such as, for example, a polyolefin or a fluorinated polymer. Some polyolefins that may be used include polyethylene and polypropylene. However, when the cable is to be placed into a service environment where good flame resistance and low smoke generation characteristics are required, it may be desirable to use a fluorinated polymer as the insulating material 20 for one or more of the conductors 18. In cases in which the insulating material is to be foamed, a conventional blowing agent is added during the processing.

Figure 2:
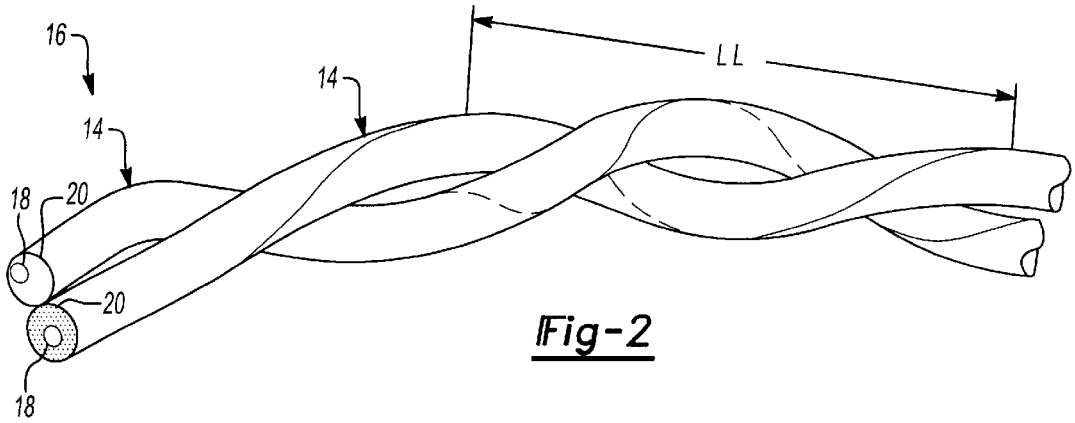
FIG. 2 is a perspective view of a portion of a pair of twisted insulated wires.

As illustrated in FIG. 2, a portion of a conventional twisted wire pair 16 is shown in further detail. The individual wires 14 of the twisted pair 16 are "lay twisted" by a 360-degree revolution about a common axis along a predetermined length, referred to as a twist length or lay length. The dimension labeled LL represents one twist length or lay length of the depicted twisted wire pair 16. In connection with the practice of the present invention, it is important to point out that specified lay lengths can be configured by those skilled in the art by using a number of conventional methods.

Figure 3:
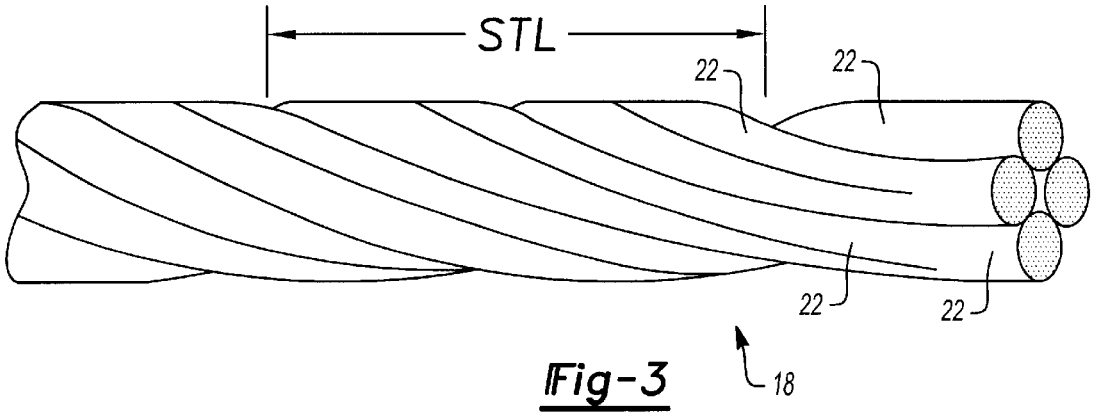
FIG. 3 is a perspective view of a portion of a stranded conductor.
Figure 4:
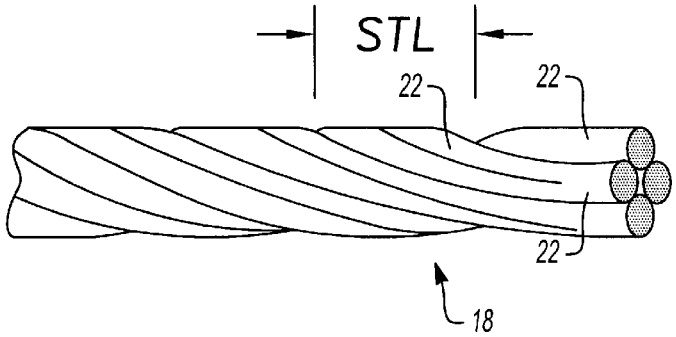
FIG. 4 is a perspective view of a portion of a stranded conductor having a strand twist length different from that shown in FIG. 3.

As more clearly shown in FIG. 3, the conductor 18 of a wire 14 of a twisted wire pair may be comprised of a plurality of wire strands 22. Although only four strands 22 are illustrated, stranded conductors can theoretically be formed from any number of strands, but will commonly be comprised of seven or nineteen strands 22. While the wire strands are depicted as having a generally circular cross-section, the strands 22 and the conductor 18 are generally not limited to a particular cross sectional form and, therefore, may be embodied in a number of cross-sectional geometric configurations. Wire strands 22 that form the conductor 18 can have different diameters and can optionally be coated with a metallic or non-metallic coating. Like the twisted pairs 16, the stranded conductor 18 is twisted by a 360-degree rotation about a common axis along a predetermined length, hereinafter referred to as a "strand twist length." The strand twist length of the conductor 18, which can be formed to specified lengths by those skilled in the art, is illustratively shown in FIG. 3 and designated as STL. FIG. 4 shows the conductor 18 having a strand twist length different from the STL shown in FIG. 3.

Referring once again to FIG. 1, the lay lengths of some of the twisted wire pairs 16 of the illustrated cable 10 are different. It is known to those skilled in the art that a difference in the lay length of the twisted wire pairs 16 will result in differences in the distance that signals must travel in the respective wire pairs over a given length of cable, and can contribute to a difference in pair to pair timing phase delay or known in industry as "delay skew." However, in accordance with one aspect of this invention, the delay skew can be matched by correlating and manipulating the lay lengths of the twisted wire pairs to the strand twist lengths of the conductors of the respective pairs. Alternately, in accordance with another aspect of the invention, the delay skew can be matched by correlating and appropriately "pairing" the strand twist lengths of the conductors to the lay length of the respective twisted wire pairs. As used herein, the term "matched" is intended to encompass differences in phase delay or delay skew of less than 25 nanoseconds per 100 meters of cable length.

EXAMPLE 1

As a first example, a stranded conductor, typically composed of 7 strands of 32 AWG wire, is twisted to form a first central conductor. The lay length (strand twist length) of the first central conductor is between 0.5 to 1.5 inches in length. Insulation is then applied to the first stranded conductor to form an insulated conductor. Then, two insulated conductors are paired and twisted together to form a first twisted pair. Preferably, the twisted central conductor have a strand twist length of 0.5 to 1.5 times the lay length of the twisted pair. Additional twisted pairs may be added to form a cable, an d each additional twisted pair may have a different lay length than the first twisted pair. In such a situation, a second twisted pair may include central conductor having a strand twist length less than the chosen strand twist length of the first central conductor as long as the lay length of the second twisted pair is greater than the first twisted pair lay length.

EXAMPLE 2

A cable is constructed of four twisted pairs (Pairs 1–4 ), having the characteristics shown in Table 1:

TABLE 1

Cable Characteristics of Example 2.

| Pair # | Central Conductor Strand Twist Length (inches) | Twisted Pair Lay Length (inches) |
|---|---|---|
| 1 | .33 | .87 |
| 2 | .36 | .74 |
| 3 | .40 | .58 |
| 4 | .50 | .49 |

Central Conductor Outer Diameter: 0.24"

Insulated Conductor Outer Diameter: 0.40"

Twisted Pair Outer Diameter: 0.80"

Overall Cable Outer Diameter: 0.250"

When constructed as described in Example 2, a cable of the present invention may achieve a capacitance of 12.5±0.5 pF/ft with a related impedance of 100±3 ohms, thereby reducing and substantially eliminating delay skew and its associated data loss. Table 1 also shows the inverse relationship between central conductor strand twist length and the insulated conductor twisted pair lay length, where longer strand twist lengths are used with shorter lay lengths to equalize capacitance between twisted pairs. It should further be noted that the central conductor outer diameter of 0.24" is measured after compression of the strands to eliminate gaps and interstitial spaces therebetween. However, compression is not required to achieve the desired transmission characteristics.

As previously mentioned, the phase delay of two twisted wire pairs can be better matched by appropriately controlling the physical configuration of the twisted wire pairs and the stranded conductor. For example, the amount of phase skew or delay skew contributed by the difference in the strand twist length of two twisted wire pairs with respect to the lay length of one twisted wire pair can be determined empirically or by calculation, and can be compensated for by selecting an appropriately correlated lay length for the other twisted wire pair 16. Conversely, if the lay lengths of the twisted pairs 16 of a given application is predetermined, the selection of wires with conductors having an appropriate strand twist length can be determined so as to better control the amount of delay skew that will result from that particular cable configuration.

In multi-pair cables having more than two twisted wire pairs, the skew value is represented by the maximum difference in phase delay between any two twisted wire pairs. In those cases, the maximum difference in phase will be adjusted by modifying the lay lengths and/or strand twist lengths of the twisted wire pairs until the amount of delay skew is within an acceptable range of 25 nanoseconds per 100 meters of cable length.

To further improve or reduce the amount of delay skew associated with the design of a multi-pair cable, other factors that affect signal propagation can be tailored to improve or intentionally slow down signal propagation in an individual twisted wire pair 16. By "tweaking" other factors in combination with the correlation of the lay length and strand twist length, a network designer can further improve the signal transmission characteristics of the cable. Such modifications can include, for example, coating the wire strands 22 of the conductor 18 with a metal or non-metallic coating, providing wire strands 22 having the same or different cross-sectional diameters, utilizing different or modified insulating materials for the conductors 18, and providing insulation material 20 surrounding the conductors 18 that is formed of different and varying thickness values.

Cables formed according to the present invention advantageously reduce the amount of delay skew significantly by utilizing longer strand twist length with the tightly twisted pair and a shorter strand twist length with the longer twisted pair. In this way, capacitance levels between dissimilar twisted pairs are optimally matched. Thus, signals generated at one end of the cable should ideally arrive at the same time at the opposite end even if they travel along different twisted wire pairs. In any event, a cable may be designed where the delay skew between any two twisted pairs within the cable is small enough that the a device receiving the signal is able to reassemble that signal, thereby eliminating data loss.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications will come within the teachings of this invention and that such modifications are within its spirit and the scope as defined by the claims.

What is claimed is:

1. A low delay skew twisted wire pair cable suitable for high-speed data transmission, comprising:

a first twisted wire pair having a first lay length, wherein each conductor of the first wire pair is comprised of a plurality of first wire strands having a first strand twist length; and a second twisted wire pair having a second lay length, wherein each conductor of the second wire pair is comprised of a plurality of second wire strands having a second strand twist length that is different than the strand twist length of the first twisted wire pair;

wherein the lay length of the first and second wire pairs are correlated with the strand twist lengths of the first and second twisted wire pairs so that a phase delay of said first and second twisted wire pairs is matched to within an acceptable range for data transmission.

2. The low delay skew cable of claim 1, wherein said strand twist lengths are inversely proportional to said lay lengths.

3. The low delay skew cable of claim 2, wherein said strand twist lengths are between about 0.5 and 1.5 inches.

4. The low delay skew cable of claim 2, wherein said first and second strand twist lengths are about 0.5 to 1.5 times said first and second lay lengths, respectively.

5. The low skew cable of claim 1, wherein the cable includes at least one additional twisted wire pair having a lay length, wherein each conductor of the at least one additional wire pair is comprised of a plurality of wire strands having a strand twist length, and further wherein, the lay length and strand twist length of the additional twisted wire pair is correlated with the lay length and strand twist length of at least one of the first and second twisted wire pairs so that the phase delay of the additional twisted wire pair is matched to within an acceptable range for data transmission.

6. The cable of claim 1, wherein the cable wherein each conductor includes an insulating outer layer.

7. The cable of claim 6, wherein the insulating outer layer is comprised of a polymer.

8. The cable of claim 7, wherein the polymer comprised of a material selected from the group consisting of a polyolefin and a fluorinated polymer.

9. The cable of claim 1, wherein the cable includes an outer jacket comprised of a plastic material.

10. The cable of claim 9, wherein said plastic material is selected from the group consisting of fluoropolymers, polyvinyl chloride, and polyvinyl chloride alloys.

11. The cable of claim 9, wherein the outer jacket is molded over said first and second twisted wire pairs.

12. The cable of claim 1, wherein said conductor is comprised of a material selected from the group consisting of copper, aluminum, copper-clad steel, and plated copper.

13. A method for making a low delay skew twisted wire pair cable suitable for high-speed data transmission, comprising:

providing a first twisted wire pair having a first lay length, and, wherein each conductor of the first pair is comprised of a plurality of first wire strands having a first strand twist length;

providing a second pair of wires, wherein each conductor of the second pair is comprised of a plurality of second wire strands having a second strand twist length which is different than the first strand twist length; and twisting the second pair of wires to provide a second lay length wherein a phase delay of the first and second twisted wire pairs is matched to within an acceptable range for data transmission.

14. The method of claim 13, wherein each conductor is surrounded by an insulating material.

15. The method of claim 13, wherein the method includes the step of calculating the lay length for the second twisted wire pair based upon a correlation between the first strand twist length, the second strand twist length, and the first lay length.

16. The method of claim 13, wherein the method includes the step of providing an outer jacket.

17. The method of claim 13, wherein at least one additional twisted wire pair is provided.

18. The method of claim 13, wherein the lay lengths of the twisted wire pairs and the strand twist lengths are matched so that the capacitance of at least one of the twisted wire pairs of the cable is within 12.5±0.5 pF/ft.

19. The method of claim 13, wherein the lay lengths of the twisted wire pairs and the strand twist lengths are matched so that the maximum phase delay between the twisted wire pairs of the cable is within an acceptable transmission range.

* * * * *